United States Patent [19]

Walden

[11] 4,186,870

[45] Feb. 5, 1980

[54] MAILBOX ATTACHMENT

[76] Inventor: Frank B. Walden, Space 38 2395 Redwood Ave., Grants Pass, Oreg. 97526

[21] Appl. No.: 921,966

[22] Filed: Jul. 5, 1978

[51] Int. Cl.[2] ..... A47G 29/12

[52] U.S. Cl. ..... 232/35; 232/34

[58] Field of Search ..... 232/35, 34

[56] References Cited

U.S. PATENT DOCUMENTS

| | | | |
|---|---|---|---|
| 2,579,877 | 12/1951 | Stone | 232/34 |
| 2,811,306 | 10/1957 | Kalmoe | 232/35 |
| 2,849,176 | 8/1958 | McMinn | 232/35 |
| 2,874,896 | 2/1959 | Hickman | 232/35 |
| 3,144,986 | 8/1964 | Hendrickson | 232/35 |
| 3,163,356 | 12/1964 | Joehuk | 232/35 |

*Primary Examiner*—Francis K. Zugel

*Attorney, Agent, or Firm*—James D. Givnan, Jr.

[57] ABSTRACT

A flag assembly includes a lateral projection at its lower end enabling flag raising by fingertip pressure. A spring biased rod includes an arm member contactable with the projection during door opening to automatically lower the flag. A link associated with the rod moves past the door hinge pin axis to lock the door open and also to close the door after initial manual door closing movement.

1 Claim, 3 Drawing Figures

MAILBOX ATTACHMENT

BACKGROUND OF THE INVENTION

The present invention concerns mailbox attachments operable in conjunction with the mailbox flag.

Numerous mailbox attachments have been devised for the purposes of positioning the mailbox flag to signal the mail carrier as well as the mailbox owner. For the most part, such attachments are complex requiring considerable modification of the box as well as incurring substantial manufacturing costs. A still further drawback to known attachments is that same do not lend themselves to incorporation with an existing mailbox but rather require installation during mailbox manufacture.

SUMMARY OF THE PRESENT INVENTION

The present invention is embodied within a mailbox attachment for actuating the box flag upon door opening and oppositely serving to assure positive door closure.

A door actuated member moves into engagement with a projection on the mailbox flag assembly to cause rotation of the flag to a lowered position coincident with door opening. Said member is biased toward a retracted position to assist closing movement and assures the door remaining tightly closed. The projection on said flag assembly additionally serves to receive fingertip pressure to enable raising of the flag to an upright position without requiring grasping of same which oftimes is difficult when mailboxes are placed close to one another on a common support.

Important objectives of the present attachment include the provision of a mailbox attachment which eases the postman's task in that he need not manually lower the flag assembly after mail pick-up as required by existing postal regulations; the provision of a mailbox a mailbox attachment including biased means which passes through an over-center position past the box door hinge to hold the mailbox door open and, after initial upward movement of door, acts to close and secure the door in a positive manner; the provision of a mailbox attachment including a friction lock for the flag assembly which assures retention of the flag assembly in a raised position; the provision of a mailbox attachment including a flag assembly having a projection thereon which permits upright positioning of the flag by fingertip pressure alone thereby avoiding difficult insertion of a hand between closely spaced mailboxes; the provision of a mailbox attachment readily installed by the box owner to an existing mailbox with the use of common household tools.

DETAILED DESCRIPTION OF THE PREFERRED EMBODIMENT

Figure 3:
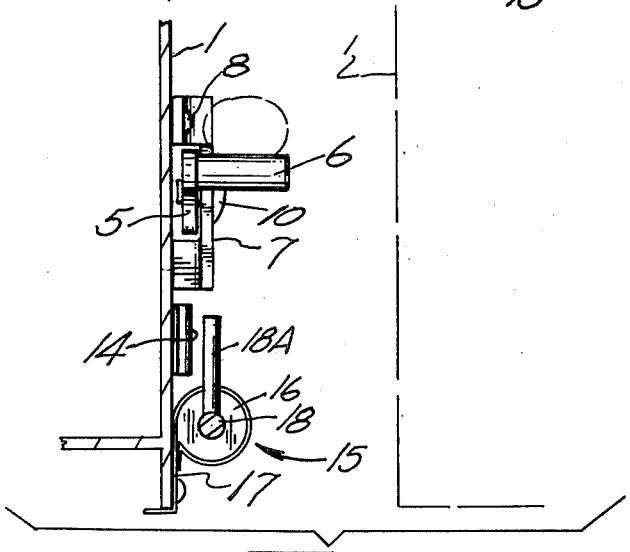
FIG. 3 is a vertical sectional view taken along line 3—3 of FIG. 2 showing details of the present attachment.

With continued attention to the accompanying drawing, the reference numeral 1 indicates a rural mailbox having a door 2 at its forward end mounted for opening movement about a pair of hinge pins as at 3. Such mailboxes are commonly individually mounted atop a post or are often mounted in common with a multitude of like mailboxes on a single horizontal support as is the case where mailbox owners reside in areas such as mobile home parks, apartments in rural areas, etc. Indicated generally at 9 is a flag assembly comprising a flag 4, a flag arm 5, at the lower end of which is a laterally extending projection 6 as best viewed in FIG. 3.

A bracket 7 supports the flag assembly and is suitably secured to the sidewall of the box as by mounting screws 8. Said bracket includes foot portions which abut the sidewall of the box and constitute limit stops for rotational movement of the flag assembly about a bracket mounted pivot 10.

A friction type lock at 12 is secured at one of its ends to the box sidewall by fasteners 13 and includes a bowed segment at 14 disposed so as to be contacted by the lower end of flag arm 5 when the flag assembly is raised to thereby lock same against accidental displacement.

Biased means, indicated generally at 15, includes a housing 16 attached to a lower side edge of the box by means of a bracket 17. Within said housing is a rod 18 which is urged by a spring 20 to the retracted position shown in FIG. 2. Rod 18 projects forwardly from said housing to pivotally receive at 21 one end of a link 22 which in turn terminates forwardly in pivotal attachment at 23 to a door mounted clip 24. Housing 16 is in juxtaposed relationship to the sidewall of the box so as to locate an arm 18A, carried by rod 18, in the path of flag arm projection 6 whereby forward movement of rod 18 during door opening causes arm member 18A to contact said projection resulting in rotational movement of flag assembly 9 to the lower position. Housing 16 is sealed against the weather to assure rod 18 being freely slidable therein in response both to door opening movement and to rod return spring 20.

Figure 1:
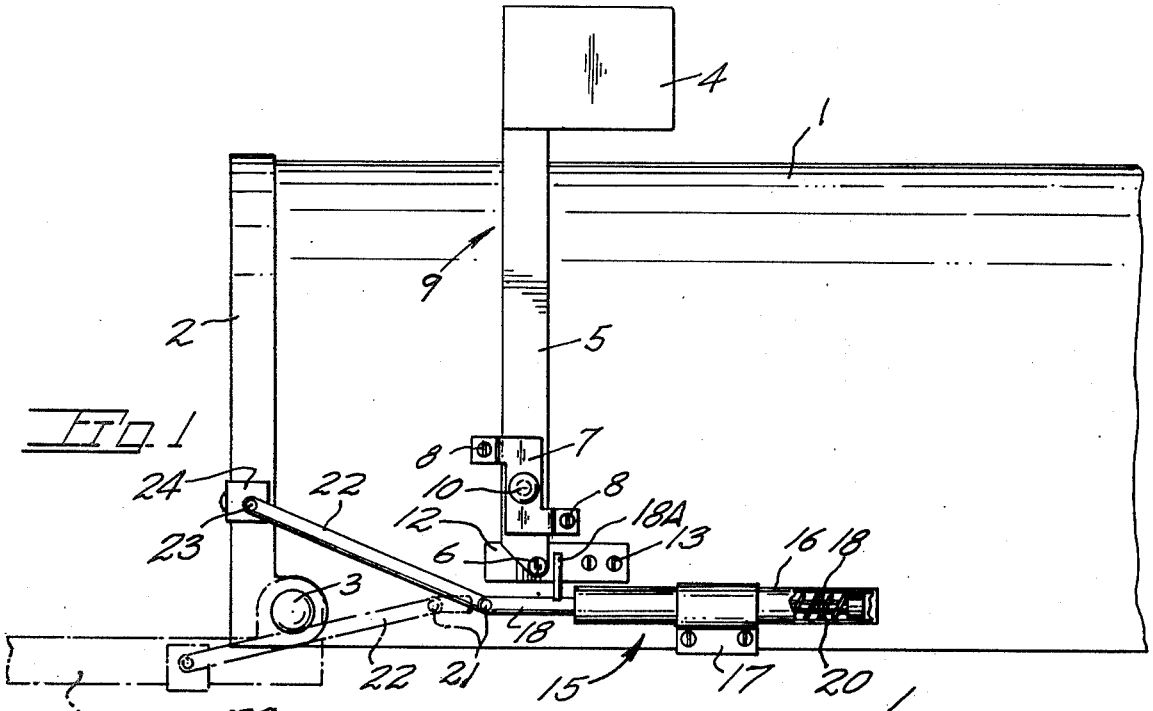
FIG. 1 is a fragmentary side elevational view of a mailbox with the present attachment thereon.

In use, the attachment may be disposed as shown in fill lines in FIG. 1 with door opening to the broken line position causing partial extraction of rod 18 with arm member 18A being advanced so as to contact projection 6 and cause automatic flag lowering.

The present attachment serves to retain door 2 in an open position by reason of link 22 passing the projected horizontal axis of door hinge pins as at 3 to provide an over-center type lock. Door closing entails imparting initial lifting movement to door 2 with spring 20 serving to thereafter securely close door 2 upon link 22 moving past the hinge pins.

Figure 2:
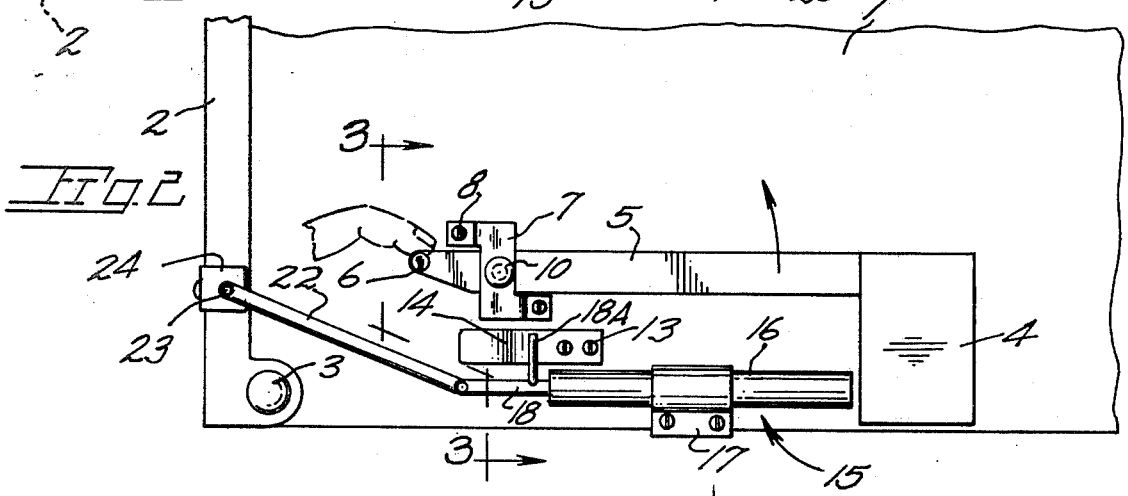
FIG. 2 is a view similar to FIG. 1 but with the flag assembly lowered and mailbox door closed.

Raising of the flag by the box owner to signal the presence of mail for pick-up by the mail carrier is accomplished, as shown in FIG. 2, by fingertip pressure exerted downwardly on projection 6 which may easily be accomplished in distinction to the method required with existing mailboxes which entails the grasping of the flag assembly and lifting same into place. Such requires the entire hand to be inserted between closely spaced boxes which can be difficult when the boxes are closely spaced.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A mailbox attachment permitting fingertip raising and automatic lowering of the mailbox flag, said attachment comprising, a flag assembly including a flag arm mounted to the mailbox for pivotal movement about a horizontal axis, said flag arm having a horizontally extending projection at its lower end to receive fingertip pressure for raising of the flag arm, a friction lock secured to said mailbox and having a bowed flexible segment disposed for friction contact with the lower end of the flag arm when the flag arm is in a raised position, biased means including a housing attached to the lower side edge of the mailbox, a spring within said housing, a rod having one end within said housing and acted upon by said spring for rod retraction, said rod including an upright arm also contactable with said horizontal projection on the flag arm for imparting lowering pivotal movement to the arm during rod extension, a clip mounted to the mailbox door, and a link pivotally connected to said clip and to the exposed end of said rod whereby said rod is extracted by door opening movement to cause the arm on said rod to contact said flag arm extension and impart lowering movement to said arm.

* * * * *